United States Patent [19]

Wilkins

[11] 4,044,848

[45] Aug. 30, 1977

[54] FLOOR TREATING MACHINES

[75] Inventor: John Thomas Wilkins, Bushey Heath, England

[73] Assignee: R. G. Dixon & Company Limited, Wembley, England

[21] Appl. No.: 652,988

[22] Filed: Jan. 28, 1976

[30] Foreign Application Priority Data

Jan. 30, 1975 United Kingdom ..... 4158/75

[51] Int. Cl.[2] ..... B62D 11/02

[52] U.S. Cl. ..... 180/6.5; 74/471 R; 74/491; 74/504

[58] Field of Search ..... 180/6.5, 19 S, 19 H, 180/77 H; 74/491, 504, 471 R, 523

[56] References Cited

U.S. PATENT DOCUMENTS

| | | | |
|---|---|---|---|
| 3,276,531 | 10/1966 | Hale | 180/6.5 |
| 3,335,808 | 8/1967 | Schaich | 180/6.5 |
| 3,792,744 | 2/1974 | Gray | 180/77 H X |

*Primary Examiner*—Joseph F. Peters, Jr.
*Assistant Examiner*—R. Schrecengost
*Attorney, Agent, or Firm*—Barlow & Barlow

[57] ABSTRACT

This invention relates to floor treatment machines, e.g. for scrubbing and polishing floors comprising a pair of driving wheels with independent speed control, a pair of independently movable manually operable control members mounted side-by-side on the machine, with each of said control members being operably connected to an individual electrical component forming part of the speed control for one of the driving wheels, whereby synchronized movement of the control members provides equal adjustment of the wheel speeds, whereas differential movement of the control members provides a steering effect. When operated by a walking operator, such machines have been found to exhibit a tendency to hunt for a selected speed, and in order to avoid this damping means is provided between the operator's control and the electrical components to reduce the sensitivity of the mechanism.

7 Claims, 9 Drawing Figures

FLOOR TREATING MACHINES

This invention relates to floor treating machines.

In U.S. Pat. No. 3,893,530 there is described a floor treating machine comprising a pair of driving wheels with independent speed control, a pair of independently movable manually operable control members or control arms mounted side-by-side on the machine, with each of such control members being operably connected to an individual electrical component forming part of the speed control for one of the driving wheels, whereby synchronized movement of the control members provides equal adjustment of the wheel speeds, whereas differential movement of the control members provides a steering effect.

The control members are also described as being operatively connected to a common handle.

It has been found that such machines may be unduly sensitive to the controls, particularly with an operator walking behind the machine, since on pushing the control handle forward to drive the machine forward, the machine then accelerates rapidly towards the new set speed. The machine thus moves forwards relative to the control handle which is retained in the operator's hand. This results in the handle moving back relative to the machine and a reduction in motor speed. The machine then has a new set speed and decelerates rapidly so that the operator, who by now is adjusting to forward movement may inadvertently push the handle harder than intended. The result is an effect which is well known in servo-mechanisms and is known as hunting. This type of control means that the operator has to be extremely skilled or sensitive to avoid jerking movements of the machine arising from the hunting effect. This effect may be lessened by providing a seat whereby the operator rides on the machine, but this increases the size and effective weight of the machine and is not usually economic.

According to the present invention this hunting is avoided in that the control is provided with at least one damping device to reduce the sensitivity of the control members to fluctuating forces applied by the operator relative to the machine, but which does not increase the steady force required.

The introduction of a damping device between the control handle and the machine introduces an element of resistance to rapid relative movement so that rapid movement of the electrical control components is resisted.

The damping device may be in the form of one or more hydraulic dampers.

Each electrical control component may be associated with an individual damper.

The present invention also includes various structural modifications of the control handle arrangement itself.

The invention will be further described with reference to the accompanying drawings, which show a preferred embodiment of the invention and some modifications thereof.

Figure 2:
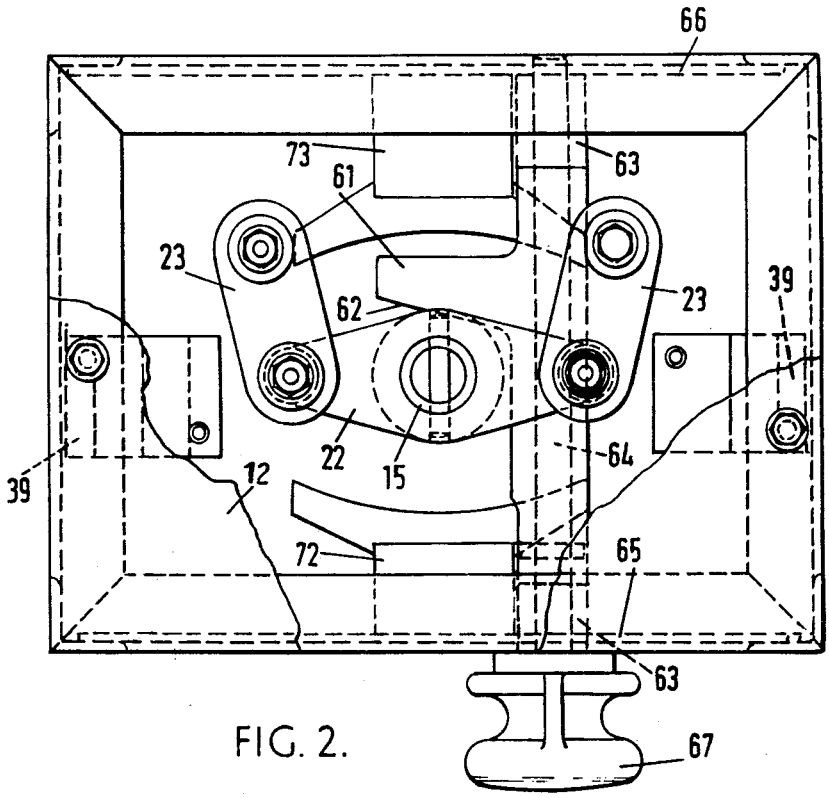
FIG. 2 is a plan view of the mechanism of FIG. 1 with a cover plate omitted.
Figure 4:
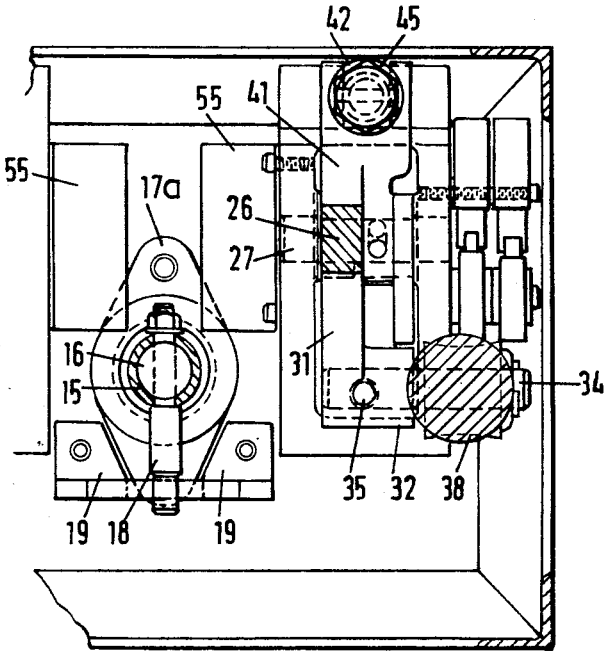
FIG. 4 is a section on the line IV—IV of FIG. 1.
Figure 3:
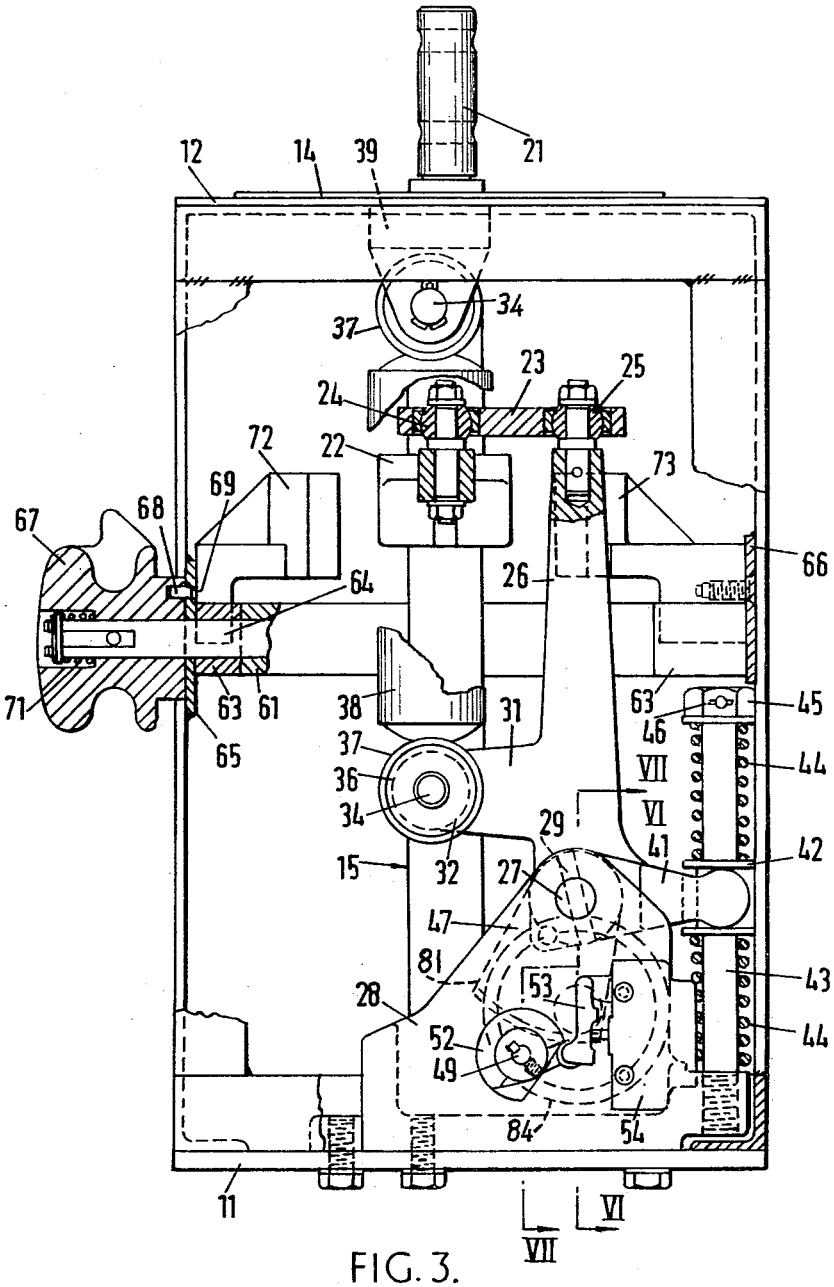
FIG. 3 is a side elevation, partly sectioned, of the mechanism of FIG. 1.
Figure 5:
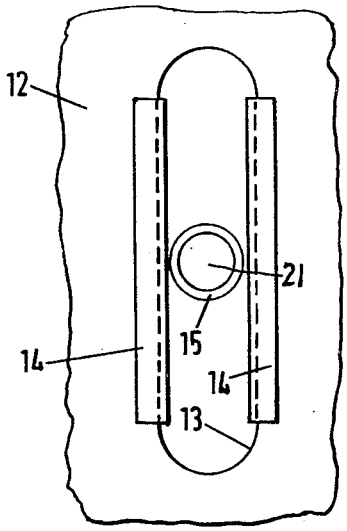
FIG. 5 is a scrap plan view of part of the cover omitted from FIG. 2.

As illustrated in the drawings, the control mechanism is mounted in a heavy frame built up from steel angle and mounted on a plate 11 on the machine. A cover 12, omitted from FIG. 2, has a slot 13 provided with rubbing strips 14 at its longitudinal edges. A control tube 15 has an upper end slidably received in the slot 13 and its lower end is secured to an adaptor spigot 16 supported by a spherical bearing 17 secured to the base 11 by a bracket 17*a*. Rotary movement of the tube is limited by engagement of a limit spigot 18 with a fixed bracket 19 (see FIG. 4). The limit spigot extends through the tube 15 and serves to secure it to the adaptor spigot 16. The upper end of the tube 15 is provided with a spigot 21 by which it is adapted to be connected to a steering handle.

Figure 1:
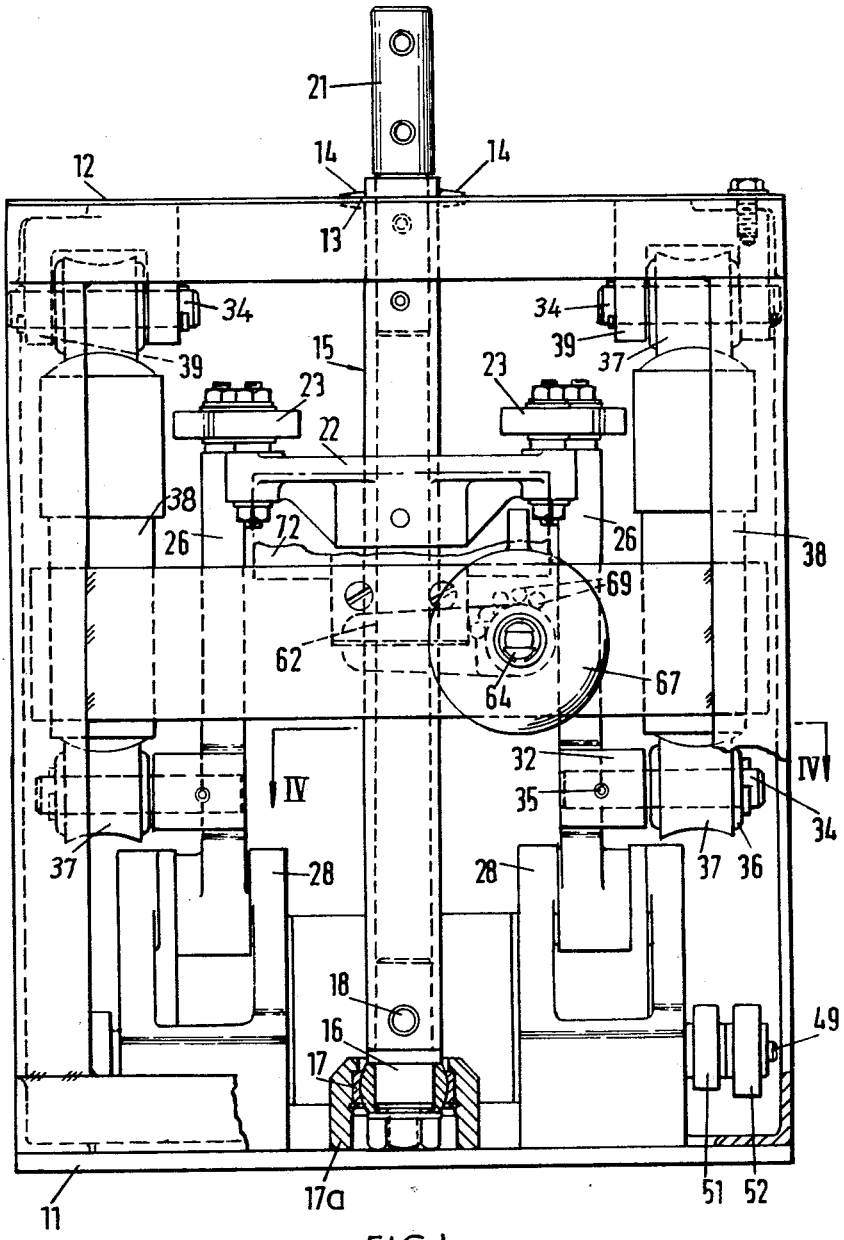
FIG. 1 is a front elevation of a form of control mechanism for use in a floor treating machine and comprises a preferred embodiment of the invention.

The control tube 15 carries a centre bracket or cross member 22 solidly therewith and this has a pair of links 23 mounted thereon by spherical bearings 24. Each link 23 is connected by a spherical bearing 25 to an individual lever or control element 26 pivoted by means of a shaft 27 to a bracket 28. The shafts 27 are drivably connected with the levers by pins 29. The levers 26 are identical in function and only the lever 26 shown in the right-hand half of FIG. 1 will be described in detail.

Each lever 26 has an arm 31 terminating in a boss 32 supporting a spindle 34 secured by a grub screw 35. The spindle 34 is received within a rubber cushion 36 in a lower mounting ring 37 of a hydraulic damper 38, of conventional type, the upper end of which is mounted in a U bracket 39 securely mounted on the frame. This arrangement provides resistance to rapid pivotal movement of the lever 26 in either direction, while allowing such movement to take place if the pressure to do so is maintained.

Each lever 26 has a further arm 41 which is bifurcated so as to be received in a collar 42 slidable on a bolt 43 between two centering springs 44, the compression of which is adjustable by a nut 45, which is held in its adjusted position by a split pin 46. The lever 26 is thus subjected to a centering force to return it to a neutral position as illustrated unless external force is applied.

Figure 6:
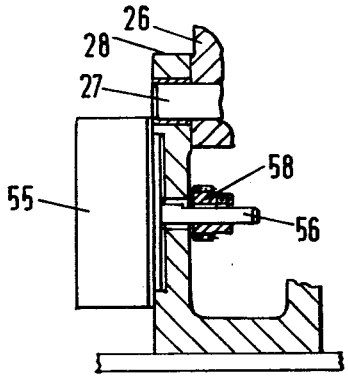
FIG. 6 is a section on the line VI—VI of FIG. 3.
Figure 7:
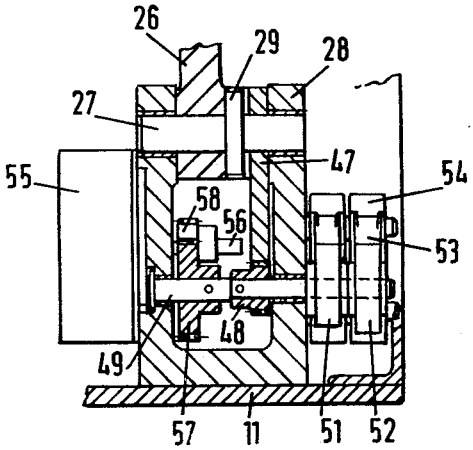
FIG. 7 is a section on the line VII—VII of FIG. 3.

Pivotal movement of the lever 26 entrains the shaft 27 and a quadrant gear 47 engaged with a pinion 48 (see FIG. 7) on a camshaft 49. The camshaft 49 carries a pair of cams 51 and 52 co-operable with operating levers 53 or appropriate microswitches 54 which are on/off and reversing switches in appropriate control circuitry for the drive motors, which circuitry also includes a variable potentiometer 55 or other variable component, for example as described in the parent patent or otherwise. The potentiometer 55 is illustrated as being of the rotary type with a spindle 56 (see FIG. 6) driven from the camshaft 49 by pinions 57 and 58.

The potentiometer controls the value of the current fed to the traction motors and also switches the direction of the motor current. The motor current is zero when the potentiometer is in the mid-position and maximum when at its extreme ends. The switches produce forward current when the handles are pushed forward and reverse when pulled back.

It can be seen that in operation, if the tube 15 is slid along the slot 13 without rotation, the levers 26 are pivoted by the same amount so that the control circuits of the individual motors are operated in the same way and the machine moves in a straight line forwards or in reverse and at a speed dependent on the sense and amount of movement of the control tube from the neutral position illustrated. Rotation of the tube 15 introduces an element of difference in motor operation, dependent on the amount of rotation.

In order to provide an adjustable limitation on the sliding movement of the control tube 15, there is provided a regulator in the form of a stop member 61 having an inclined stop surface 62, and adjustable in position whereby the position of the portion of the stop surface in the path of the tube may be adjusted. The stop member 61 is mounted with two spacers 63 on a regulator shaft 64 mounted in front and rear plates 65 and 66 welded to the frame. An adjusting knob 67 carries a dowel 68 engageable in apertures 69 in the front plate 65 to define fixed positions for the knob 67. The knob 67 is slidably and drivably mounted on one end of the shaft 64 and is urged by a spring 71 towards the plate 65. To adjust the position of the stop member 61, it is only necessary to pull the knob 67 to release the dowel 68 from an aperture, rotate the knob to the new required position, and release for the dowel 68 to engage in a different aperture 69.

Front and rear stop brackets 72 and 73 for the levers 26 are also mounted fixedly adjacent the stop member 61.

Figure 8:
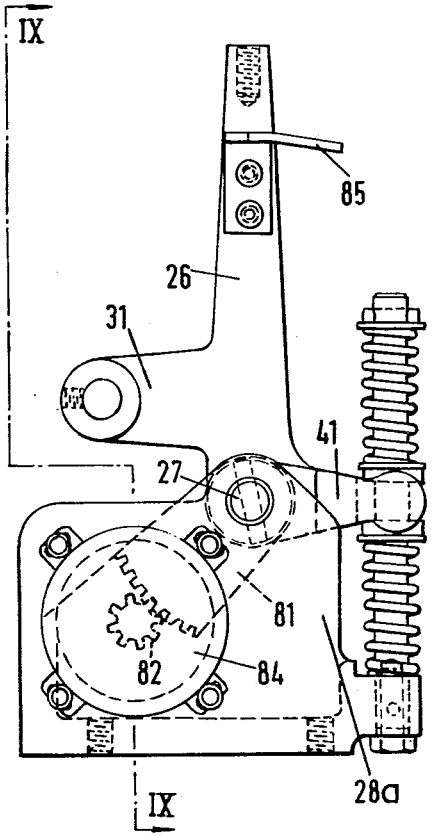
FIG. 8 is an elevation, similar to part of FIG. 3 showing a modification.
Figure 9:
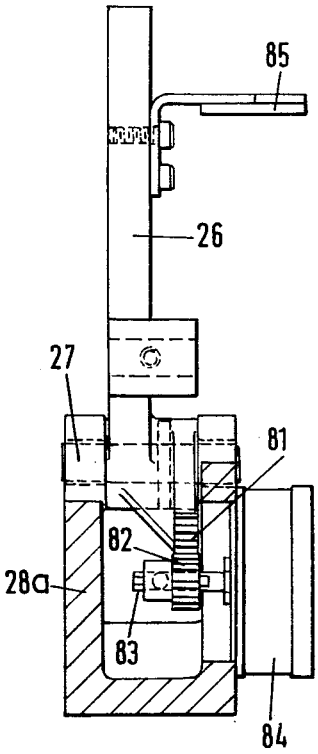
FIG. 9 is a section on the line IX—IX of FIG. 8.

FIGS. 8 and 9 illustrate a lever 26 which has the arms 31 and 41 as already described and is pivoted in a bracket 28*a*. The shaft 27, which rotates with the lever 26 carries a quadrant or sector gear 81 which is in mesh with a gear 82 non-rotatably mounted on the shaft 83 of a potentiometer 84. This represents a considerable simplification over the previously described embodiment. A further simplification is that a single on/off switch (not shown) is operated by movement of the lever by means of a switch operating plate 85 mounted directly on the lever 26. There is no need for a separate reversing switch since the potentiometer itself will provide positive or negative signals depending on the direction of its rotation from a central neutral position.

Various modifications may be made within the scope of the invention.

I claim:

1. In a floor treating machine comprising a pair of driving wheels with independent speed control, a control tube mounted in a swivel joint to move differentially, a pair of independently movable manually operable control members mounted to move on parallel axes side by side on the machine, a cross member on the control tube and links connecting the said cross member to the control members with each of such control members being operably connected to an individual electrical component forming part of the speed control for one of the driving wheels, guide means to restrict the said control elements to fore and aft movement in relation to the machine, whereby synchronized movement of the control members provides equal adjustment of the wheel speeds, whereas differential movement of the control members provides a steering effect: the improvement of at least one damping device associated with each of the electrical control components to reduce the sensitivity thereof to fluctuating forces applied by an operator and a switch operating means mounted on at least one control member.

2. A floor treating machine as claimed in claim 1, in which the said at least one damping device is an hydraulic damper.

3. A floor treating machine as claimed in claim 2, in which each of the said electrical control components is associated with one individual hydraulic damper.

4. A floor treating machine as claimed in claim 1, in which means is provided for adjustably limiting the fore-and-aft movement of the control element.

5. A floor treating machine as claimed in claim 1, comprising a centering device for each of the control members, the said control members each having a first area connected to the associated damping device and a second area connected to the centering device.

6. A floor treating machine as claimed in claim 1, comprising a shaft associated with each control element which is solidly rotatable with the shaft, and operating means on the shafts for operating the associated electrical control components.

7. A floor treating machine as claimed in claim 6, comprising a gear sector mounted on each shaft and a meshing gear on the associated electrical components.

* * * * *